United States Patent [19]

Kanai

[11] Patent Number: 4,568,124

[45] Date of Patent: Feb. 4, 1986

[54] VEHICLE SEAT

[75] Inventor: Takashi Kanai, Akishima, Japan

[73] Assignee: Tachikawa Spring Co., Ltd., Japan

[21] Appl. No.: 583,032

[22] Filed: Feb. 23, 1984

[51] Int. Cl.[4] ..... A47C 7/02

[52] U.S. Cl. ..... 297/452; 297/192; 297/458; 297/DIG. 1; 297/DIG. 3; 297/DIG. 6

[58] Field of Search ..... 297/DIG. 1, DIG. 3, 297/DIG. 6, 452, 458, 192

[56] References Cited

U.S. PATENT DOCUMENTS

| | | | |
|---|---|---|---|
| 2,136,510 | 11/1938 | Jensen | 297/DIG. 2 |
| 2,976,916 | 3/1961 | Schlandermundt et al. | 297/DIG. 3 |
| 3,321,237 | 5/1967 | Gangell | 397/192 X |
| 3,603,639 | 9/1971 | Wilson | 297/DIG. 9 |
| 4,403,356 | 9/1983 | Urai | 297/458 |

FOREIGN PATENT DOCUMENTS

| | | | |
|---|---|---|---|
| 2717268 | 10/1978 | Fed. Rep. of Germany | 297/DIG. 1 |
| 678905 | 12/1964 | Italy | 297/DIG. 1 |
| 59-40952 | 3/1984 | Japan . | |
| 1440532 | 6/1976 | United Kingdom | 297/DIG. 1 |

*Primary Examiner*—James T. McCall

*Attorney, Agent, or Firm*—Cushman, Darby & Cushman

[57] ABSTRACT

A seat for use in automobiles or airplanes is disclosed which comprises a base frame of a hollow synthetic resin to be fixed to a vehicle body, a cushion body of a foam material to be placed over and fixed to the base frame, and a top member placed over the surface of the cushion body to cover the same, characterized in that the base frame is provided along its side walls a cushion body fixing flange portion as well as along its upper surface periphery with expanded portions that are formed by expanding the base frame outwardly and upwardly.

6 Claims, 12 Drawing Figures

VEHICLE SEAT

BACKGROUND OF THE INVENTION

1. Field of the Invention

The present invention relates to a vehicle seat and, more particularly, to a lightweight vehicle seat.

Description of the Prior Art

Conventionally, a typical seat for weight reduction is constructed by placing a cushion body of a foam material over a saucer-like hard synthetic resin frame and covering the cushion body with a top layer member. In such conventional seat, when a soft cushion body is used from the point of view of improved sitting comfort as well as shape-retention, there are extended frame wires around the soft cushion body. Similarly when a hard cushion body is employed, a relatively soft block body is embedded in the central portion of the hard cushion body.

Although such a conventional seat can achieve its purpose of reducing weight by means of its structure and can prevent the seat from losing shape while also improving the sitting comfort using a cushion body of a foam material, it cannot provide a sufficient seat sitting surface and thus an occupant, when seated on such a seat, may slide forwards or roll unnecessarily.

SUMMARY OF THE INVENTION

Accordingly, it is the object of the invention to provide a lightweight-oriented vehicle seat which provides a predetermined sitting surface configuration with certainty and thus prevents the forward sliding and rolling of an occupant so as to improve the riding comfort of the occupant.

In order to achieve this object, according to one aspect of the invention, a base frame for carrying a cushion body of a foam material thereon is constructed in a hollow configuration and is formed along the periphery of its upper surface with upwardly-expanded portions. For stable placement of the cushion body onto the base frame, the base frame is provided at its side walls with integral flange portions.

According to another aspect of the invention, the base frame is constructed to have a hollow structure so as to exhibit a cushioning property. The hollow structure with the cushioning property allows the cushion body of a foam material to be reduced in thickness and this cushioning property is capable of adjustments depending on varying weights of occupants of the seat.

According to another aspect of the invention, the cushion body can be mounted onto and removed from the base frame in a simple manner. For this end, there are provided interengageable fastening members such as fasteners on the upper surfaces of the flange portions as well as on a top layer member.

According to still another aspect of the invention, the base frame is provided with a take-out opening with a fitting cover so that the base frame can also be used as a storage compartment.

According to yet another aspect of the invention, there is provided a stand-up wall within the base frame so as to increase the strength of the base frame.

BRIEF DESCRIPTION OF THE DRAWINGS

How the foregoing object and features are attained will appear more fully from the following description referring to the accompanying drawings, in which:

FIG. 9(A) is a partially cut-away perspective view illustrating the state of the invention before top member is pulled in; and, FIGS. 9(B), 10 and 11 are respectively longitudinal section views illustrating the state of the invention after the top member is pulled in.

DETAILED DESCRIPTION OF PREFERRED EMBODIMENTS OF THE PRESENT INVENTION

Figure 1:
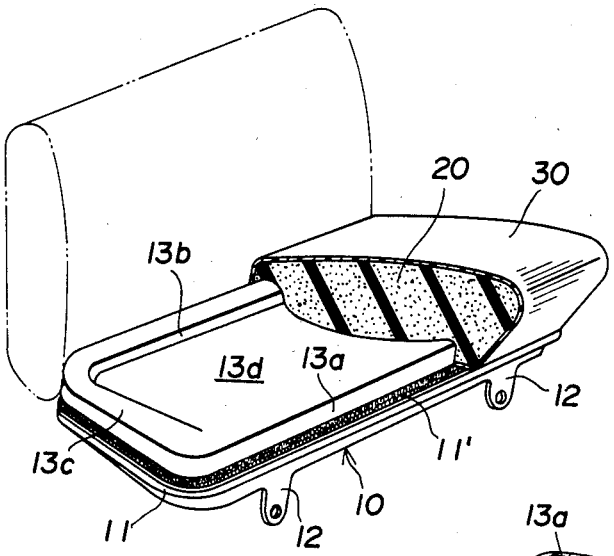
FIG. 1 is a perspective view of a first embodiment of the invention, with part thereof being cut away.
Figure 2:
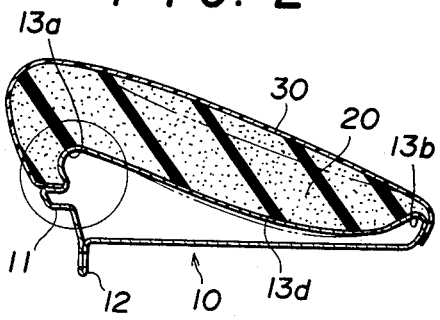
FIG. 2 is a longitudinal sectional side view of the first embodiment of the invention.
Figure 4:
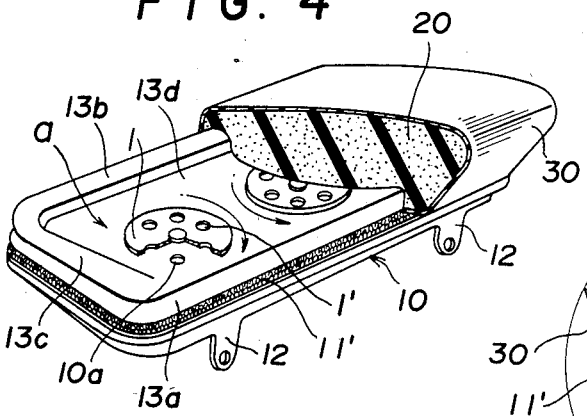
FIG. 4 is a partially cut-away perspective view of a second embodiment of the invention.
Figure 3:
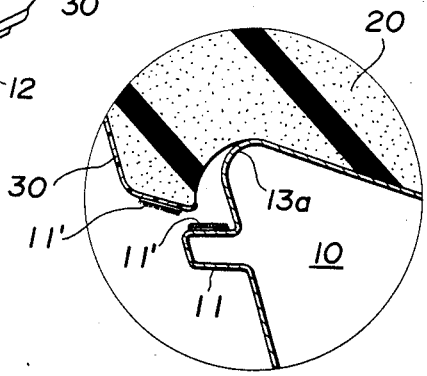
FIG. 3 is a partially enlarged longitudinal section of the first embodiment shown in FIG. 2.
Figure 6:
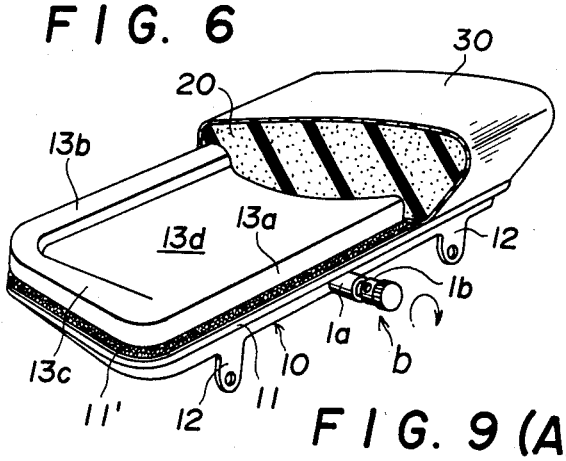
FIG. 6 is a partially cut-away perspective view of a third embodiment of the invention.
Figure 5:
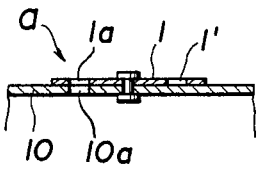
FIG. 5 is a partially enlarged longitudinal section of the second embodiment shown in FIG. 4.
Figure 7:
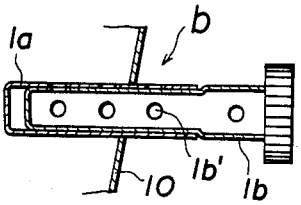
FIG. 7 is a partially enlarged longitudinal section of the third embodiment shown in FIG. 6.

In FIGS. 1 to 3, a first embodiment of the invention is shown. In the drawings, reference numeral (10) designates a hollow base frame which is formed of a synthetic resin and fixed to the floor surface of a vehicle body. Base frame (10) is so formed of a thermoplastic synthetic resin such as polyethylene or polypropylene by blow molding as to have a hollow, substantially box-shaped, closed structure. It is provided on its right, left and front side walls with respective flange portions (11) for fixing a cushion body and also includes in its front bottom portion integrally formed lug portions (12)(12). In addition, the base frame (10) is provided along the peripheries of its upper surface with upwardly expanded portions **(13*a*)(13*b*) (13*c*). The central portion (13*d*) of the upper surface of the base frame (10) which is surrounded by these expanded portions (13*a*)(13*b*)(13*c*) is inclinded such that it increases in height from its rear side toward its front side (see FIG. 2). The lug portions (12) (12) are adapted to be fixed to the floor surface of the vehicle body by fasteners, such as bolts. Detachable engaging or fastening members (11') (such as hook and pile-type fabric fasteners) are provided on the upper surface of each of the cushion fixing flange portion (11) so as to fix a cushion body (20) through a top member (30), providing a complete seat (see FIG. 3**).

The cushion body (20) formed of a foam material is thus disposed on the base frame (10). Cushion body (20) has a bottom surface which is formed to correspond to the shape of the base frame (11) so that it can be disposed, evenly over the base frame, i.e., over the range from the upper surface of the base frame (10) to the cushion body fixing flange portions (11) with no clearance produced. The cushion body (20) also defines an upper surface sloped risingly from its rear portion towards its front portion. When mounting the cushion body (20) onto the base frame (10), as described before, the right, left and front side portions of the cushion body (20) are placed on the cushion body fixing flange portion (11) of the base frame (10), while the rear portion of the cushion body is placed on the rear wall of the base frame (10). Then all of these portions may be detachably mounted through the top member (30) to the base frame by means of the fastening members (11'). The top member (30), in this embodiment, is fixed integrally to the cushion body (20) by adhesion or other suitable means, but it may also be formed as a separate member from the cushion body (20).

In this manner, since the peripheries of the cushion body (20) are supported by the expanded portions (13*a*) (13*b*) (13*c*) of the base frame (10), the cushion body (20) can provide a suitable sitting surface configuration, which prevents forward sliding or rolling movement of the occupant. Also, according to the invention, since the base frame (10) is constructed in a closed form, it will produce air-damping effects (Chain line in FIG. 2) which can eliminate the bottoming feeling of the cushion body (20).

Referring to FIGS. 4 to 7, the base frame (10) is provided with an adjustment value (a) or (b) which controls the amount of air to be discharged from the base frame, so that the amount of flexure of the central portion of the base frame (10) can be controlled. In particular, the adjustment value (a) shown in FIGS. 4 and 5 comprises a disk member (1) rotatably mounted onto the upper surface of the base frame (10) and having through-bores (1') to be engaged with through-bores (10*a*) formed in the base frame (10). On the other hand, the adjustment value (b) illustrated in FIGS. 6 and 7 comprises a first cylindrical tube (1*a*) having through-bores and inserted into the side wall of the base frame (10) and a second cylindrical tube (1*b*) rotatably fitted into the first cylindrical member (1*a*) and provided with through-bores (1*b*') to be engaged with the through-bores of the first cylindrical member (1*a*). Although not shown, in both of the embodiments mentioned above, the base frame may or may not be provided with an air inlet port for charging air within the base frame as desired.

Figure 8:
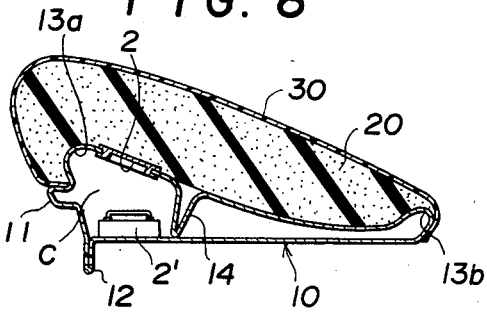
FIG. 8 is a longitudinal section view of the invention in which the base frame is used as a goods storage.
Figure 9:
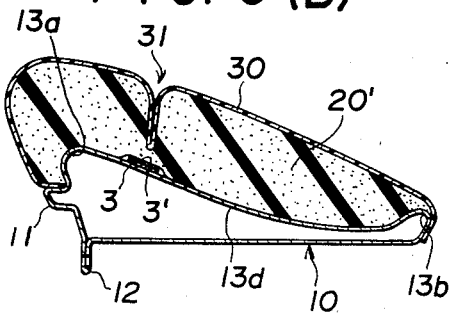

FIG. 8 illustrates another embodiment of invention in which the base frame (10) is provided on its upper surface with an opening (2) having a cover and also includes a stand-up wall (14) projected from its upper surface to its lower surface so as to increase the strength of the base frame (10). The area enclosed by the stand-up wall (14) and the front side wall of the base frame (10) is formed as a goods storage (c) in which goods (2') can be stored.

Figure 9:
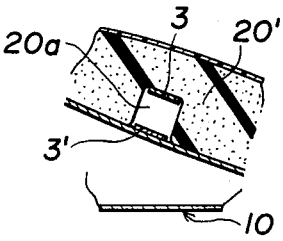

FIGS. 9(A)(B), 10 and 11, show other embodiments of the invention wherein the top member (30) is hung in and the seat is formed on its surface with recesses (31)(32)(33) so as to provide a fine appearance for the seat surface configuration. Specifically, in the embodiment shown in FIGS. 9(A) and (B), the cushion body (20') is formed in its bottom portion with a recessed cavity (20*a*), and, within the recessed cavity (20*a*) as well as on the base frame (10) located below this cavity, there are respectively fixed fastening members (3)(3') such as velvet-type fasteners which can be interengaged with each other (FIG. 9A). The cushion body (20') on the recessed cavity (20*a*) is pushed downwards together with the top member (30) to bring these two fastening members (3) (3') into interengagement with each other so as to provide a pleated portion (31).

Figure 10:
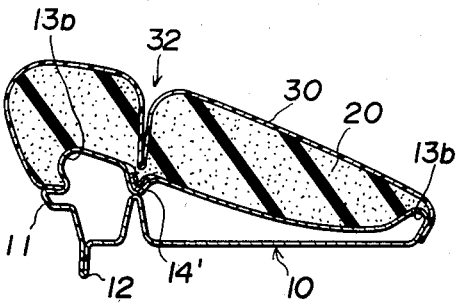

FIG. 10 illustrates another embodiment of the invention wherein the base frame (10) is formed on its upper surface with a recessed cavity (14') and engagement or fastening members are fixed in the same manner as in the last mentioned embodiment; and then, the cushion body (20) and top member (30) are pushed into this recessed cavity (14') to bring the two fastening members into interengagement with each other so as to provide a recessed portion (32).

Figure 11:
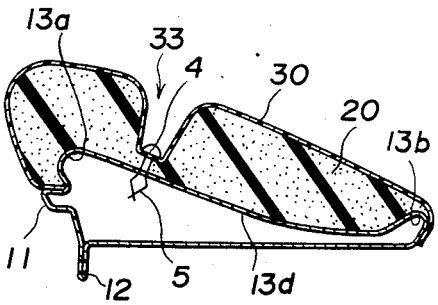

Still another embodiment of the invention is shown in FIG. 11 in which an insertion member (5) with a button (4) is inserted through the top member (30) onto the cushion body (20) and is fixed to the base frame (10) so that a recessed portion (33) is formed.

Since the present invention is constructed in the above mentioned manner, it offers the following advantages:

(1) Since the peripheries of the cushion body of a foam material are supported by the expanded portions of the base frame, the seat of the invention can provide a desirable seat sitting surface and thus prevent the occupant from sliding forwardly or rolling, which maintains the occupant body more stable and gives the occupant better riding comfort over the conventional seat of this type; and, (2) The base frame is formed along its upper surface periphery with expanded portions that are expanded out upwardly, and thus it exhibits a high toughness against vertical loads applied and will not be deformed or be broken. Also, since it is formed of a synthetic resin in a hollow structure, it can produce air damping effects in its central portions which can absorb any bottoming actions and improve its cushioning property. Moreover, the hollow structure allows lighter weights than those of the prior art seat as well as the base frame to store necesarry goods or accessories therein.

Accordingly, it can be easily understood from the foregoing description that the present invention can attain its expected object.

What is claimed is

1. A vehicle seat comprising a base frame constructed of a synthetic resinous material and defining a closed interior cavity, said base frame including a horizontal flange disposed along the sides and front of said base frame and continuous upwardly-expanded portions disposed integrally with the upper periphery of the sides and a rear of said base frame thereby establishing a central region thereof, said central region being upwardly sloped from said rear to said front of said base frame;

a cushion member including a cushion body and a cover member covering said cushion body, said cushion member being removably placed upon said base frame so as to cover said central region;

said flange and said cushion member together including fastening means to removably fasten said cushion member to said flange.

2. A vehicle seat as in claim 1 further comprising valve means in fluid communication with said closed interior cavity to control the amount of air discharged from said interior cavity upon a compressive load being applied to said cushion member.

3. A vehicle seat as in claim 2 wherein said valve means includes a plurality of openings defined in said central region and a disc member defining apertures and being rotatably mounted to said central region in covering relationship with said defined openings such that selective rotation of said disc member registers said apertures and openings to thereby permit discharge of air from said closed cavity to thereby permit flexure adjustment of said central region.

4. A vehicle seat as in claim 2 wherein said valve means includes a stationary first tube fixed to said base frame and defining a plurality of openings in fluid communication with said closed cavity, and a second tube defining apertures capable of registry with said openings, said second tube rotatably mounted to said first tube so that selective rotation of said first tube relative said second tube effects registry between said openings and apertures to permit discharge of air from said closed cavity to thereby effect flexure adjustment of said central region.

5. A vehicle seat as in claim 1 wherein said base frame includes integral partition means to partition said closed cavity into first and second sub-cavities and for providing structural reinforcement of said base frame, said central region defining an opening to establish communication with one of said sub-cavities so that goods may be stored therein, and a removable cover for covering said opening.

6. A vehicle seat as in claim 1 wherein said cushion member defines a recessed cavity in confronting relationship to a predetermined portion of said central region, said recessed cavity and said central region respectively including first and second parts of a two-part fastening system, said first part being initially spaced from said second part such that upon interengagement of said first and second parts, a visible pleat is formed in said cushion member.

* * * * *